US006655158B1

(12) United States Patent
Wiseman et al.

(10) Patent No.: US 6,655,158 B1
(45) Date of Patent: Dec. 2, 2003

(54) SYSTEMS AND METHODS FOR BOOSTING ICE RATE FORMATION IN A REFRIGERATOR

(75) Inventors: Joshua Stepen Wiseman, Elizabethtown, KY (US); Stephen Bernard Froelicher, Shepardsville, KY (US); Jeffery Wayne Borden, Louisville, KY (US); Jeffrey Lynn Jessie, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/637,045

(22) Filed: Aug. 11, 2000

(51) Int. Cl.[7] ..... F25C 1/12
(52) U.S. Cl. ..... 62/73; 62/353
(58) Field of Search ..... 62/71, 73, 351, 62/353

(56) References Cited

U.S. PATENT DOCUMENTS

| | | | | | |
|---|---|---|---|---|---|
| 3,055,186 | A | * | 9/1962 | Linstromberg et al. | 62/353 |
| 3,126,714 | A | * | 3/1964 | Zuercher, Jr. | 62/353 |
| 3,146,606 | A | * | 9/1964 | Grimes et al. | 62/351 |
| 3,182,464 | A | * | 5/1965 | Archer | 62/353 |
| 3,192,726 | A | | 7/1965 | Newton | |
| 3,200,600 | A | | 8/1965 | Elfving | |
| 3,205,666 | A | | 9/1965 | Gould et al. | |
| 3,270,519 | A | * | 9/1966 | Pohl, Jr. | 62/353 |
| 3,332,807 | A | | 7/1967 | Boehmer et al. | |
| 3,382,682 | A | * | 5/1968 | Frohbieter | 62/72 |
| 3,541,806 | A | * | 11/1970 | Jacobs | 62/351 |
| 3,771,319 | A | | 11/1973 | Nichols et al. | |
| 4,055,053 | A | | 10/1977 | Elfving et al. | |
| 4,424,683 | A | | 1/1984 | Manson | |
| 4,475,357 | A | | 10/1984 | Linstromberg | |
| 4,487,024 | A | | 12/1984 | Fletcher et al. | |
| 4,587,810 | A | | 5/1986 | Fletcher | |
| 4,644,753 | A | | 2/1987 | Burke | |
| 4,727,720 | A | * | 3/1988 | Wernicki | 62/353 |
| 4,843,833 | A | | 7/1989 | Polkinghorne | |
| 5,477,699 | A | | 12/1995 | Guess et al. | |
| 5,711,159 | A | | 1/1998 | Whipple, III | |
| 5,778,677 | A | | 8/1998 | Hung et al. | |
| 6,351,955 | B1 | * | 3/2002 | Oltman et al. | 62/71 |

* cited by examiner

*Primary Examiner*—William E. Tapolcai
(74) *Attorney, Agent, or Firm*—H. Neil Houser, Esq.; Armstrong Teasdale, LLP

(57) ABSTRACT

In one aspect, the present invention is directed to a refrigerator that includes an icemaker that is operable to .form ice at a first rate during normal operation, and at a second, faster, rate upon demand for additional ice. More specifically, and in an exemplary embodiment, the refrigerator includes a fresh food compartment and a freezer compartment. The refrigerator also includes a refrigeration circuit having a compressor, a condenser, and an evaporator connected in series. A condenser fan is positioned to blow air over the condenser and an evaporator fan is positioned to blow air over the evaporator. The icemaker is located in the freezer compartment and positioned so that the evaporator blows air over an ice mold of the icemaker. The refrigerator also includes a control coupled to a user interface and to the evaporator fan. The control includes a processor, and the processor is programmed to control energization of the evaporator fan upon selection of an ice rate booster mode at the user interface. By operating the evaporator fan to blow air over the ice mold upon command at the user interface, ice can be formed at a faster rate to satisfy the ice needs of the user. Such operation is more responsive to user needs than systems in which the ice forming rate is not responsive to user inputs.

15 Claims, 7 Drawing Sheets

TO FIG 9B

SYSTEMS AND METHODS FOR BOOSTING ICE RATE FORMATION IN A REFRIGERATOR

BACKGROUND OF THE INVENTION

This invention relates generally to refrigerators, and more particularly, to ice making function in such refrigerators.

Some known refrigerators include a fresh food compartment and a freezer compartment. Such a refrigerator also typically includes a refrigeration circuit including a compressor, evaporator, and condenser connected in series. An evaporator fan is provided to blow air over the evaporator, and a condenser fan is provided to blow air over the condenser.

In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

An icemaker may be located in the freezer compartment and operable to make ice cubes. A primary mode of heat transfer for making ice is convection. Specifically, by blowing cold air over an icemaker mold body, heat is removed from water in the mold body. As a result, ice is formed in the mold. Typically, the cold air blown over the icemaker mold body is first blown over the evaporator and then over the mold body by the evaporator fan.

Heat transferred in a given fluid due to convection can be increased or decreased by changing a film coefficient. The film coefficient is dependent on fluid velocity and temperature. With a high velocity and low temperature, the film coefficient is high, which promotes heat transfer and increasing the ice making rate. Therefore, when the refrigeration system is activated, i.e., when the compressor, evaporator fan, and condenser fan are on, ice is made at a quick rate as compared to when the refrigeration is inactivated. Specifically, the air is not as cold and the air velocity is lower when the system is inactivated as compared to when the system is activated.

User demand for ice, however, is not related to the state of the refrigeration system. Specifically, a user may have a high demand for ice at a time in which the system in inactivated or may have no need for ice at a time at which the system is activated. Therefore, ice may be depleted during a period of high demand for ice by a user and the refrigeration system may not necessarily respond to the user demand by making ice more quickly.

BRIEF SUMMARY OF THE INVENTION

In one aspect, the present invention is directed to a refrigerator that includes a refrigerator compartment that is operable to form ice at a first rate during normal operation, and at a second, faster, rate upon demand for additional ice. More specifically, and in an exemplary embodiment, the refrigerator includes a fresh food compartment and a freezer compartment. The refrigerator also includes a refrigeration circuit having a compressor, a condenser, and an evaporator connected in series. A condenser fan is positioned to blow air over the condenser and an evaporator fan is positioned to blow air over the evaporator. The icemaker is located in the freezer compartment and positioned so that the evaporator blows air over an ice mold of the icemaker.

The refrigerator also includes a control coupled to a user interface and to the evaporator fan. The control includes a processor, and the processor is programmed to control energization of the evaporator fan upon selection of an ice rate booster mode at the user interface. By operating the evaporator fan and/or freezer compartment temperature to blow air over the ice mold upon command at the user interface, ice can be formed at a faster rate to satisfy the ice needs of the user. Such operation is more responsive to user needs than systems in which the ice forming rate is not responsive to user inputs.

DETAILED DESCRIPTION OF THE INVENTION

Ice formation systems and methods are described herein in the context of residential, or domestic, refrigerators. The ice formation systems and methods can, however, be utilized in connection with commercial refrigerators as well as in standalone ice makers, i.e., ice makers that are not part of a larger freezer compartment or refrigerator. Therefore, the ice formation systems and methods described herein are not limited to use in connection with only ice makers utilized in residential refrigerators, and can be utilized in connection with ice makers in many other environments. In addition, ice formation systems and methods are sometimes described herein in the context of a side-by-side type refrigerator. Such systems and methods are not, however, limited to use in connection with side-by-side type refrigerators and can be used with other types of refrigerators, e.g., a top mount type refrigerator.

Figure 1:
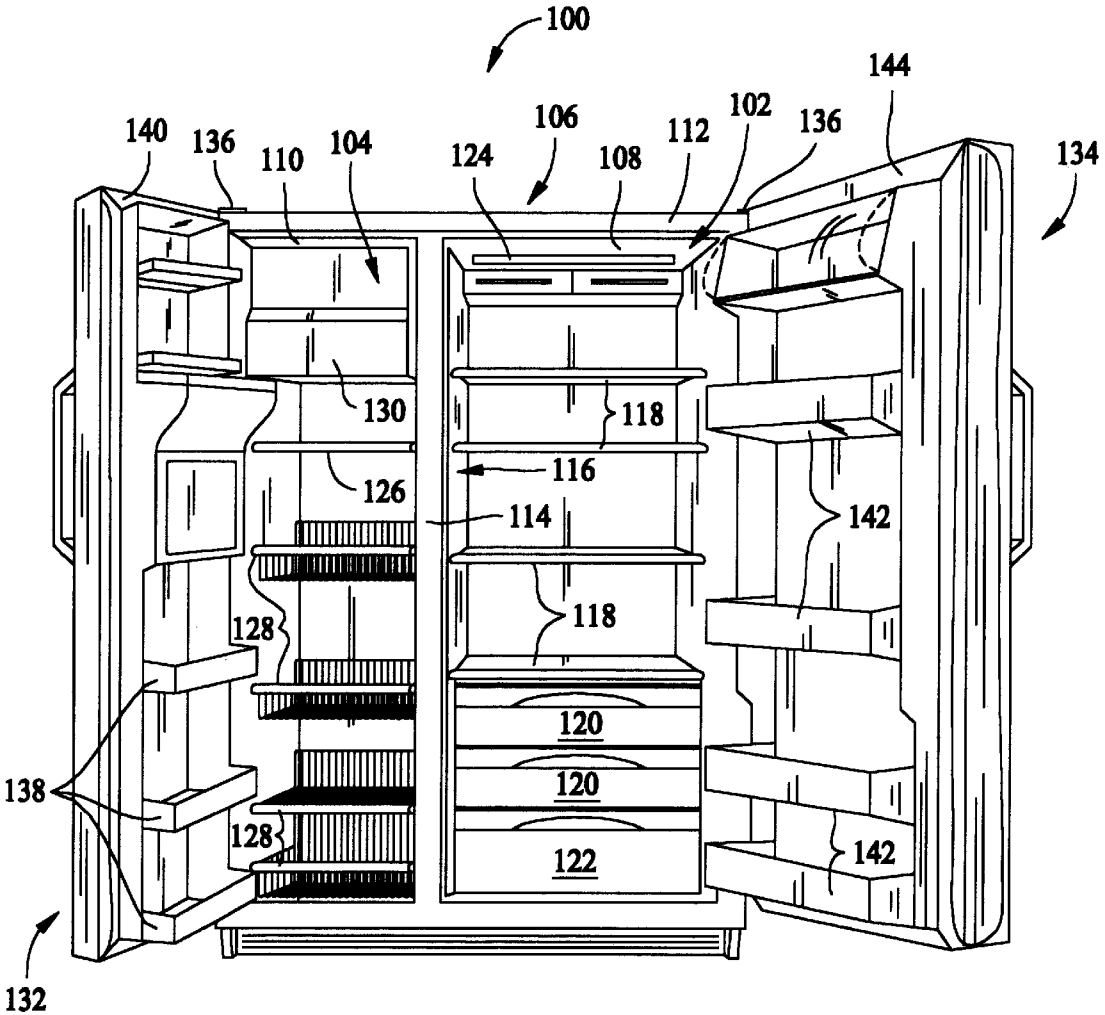
FIG. 1 illustrates a side-by-side type refrigerator.

FIG. 1 illustrates a side-by-side refrigerator 100 including a fresh food storage compartment 102 and freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown in FIG. 1) described in detail below and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice-maker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
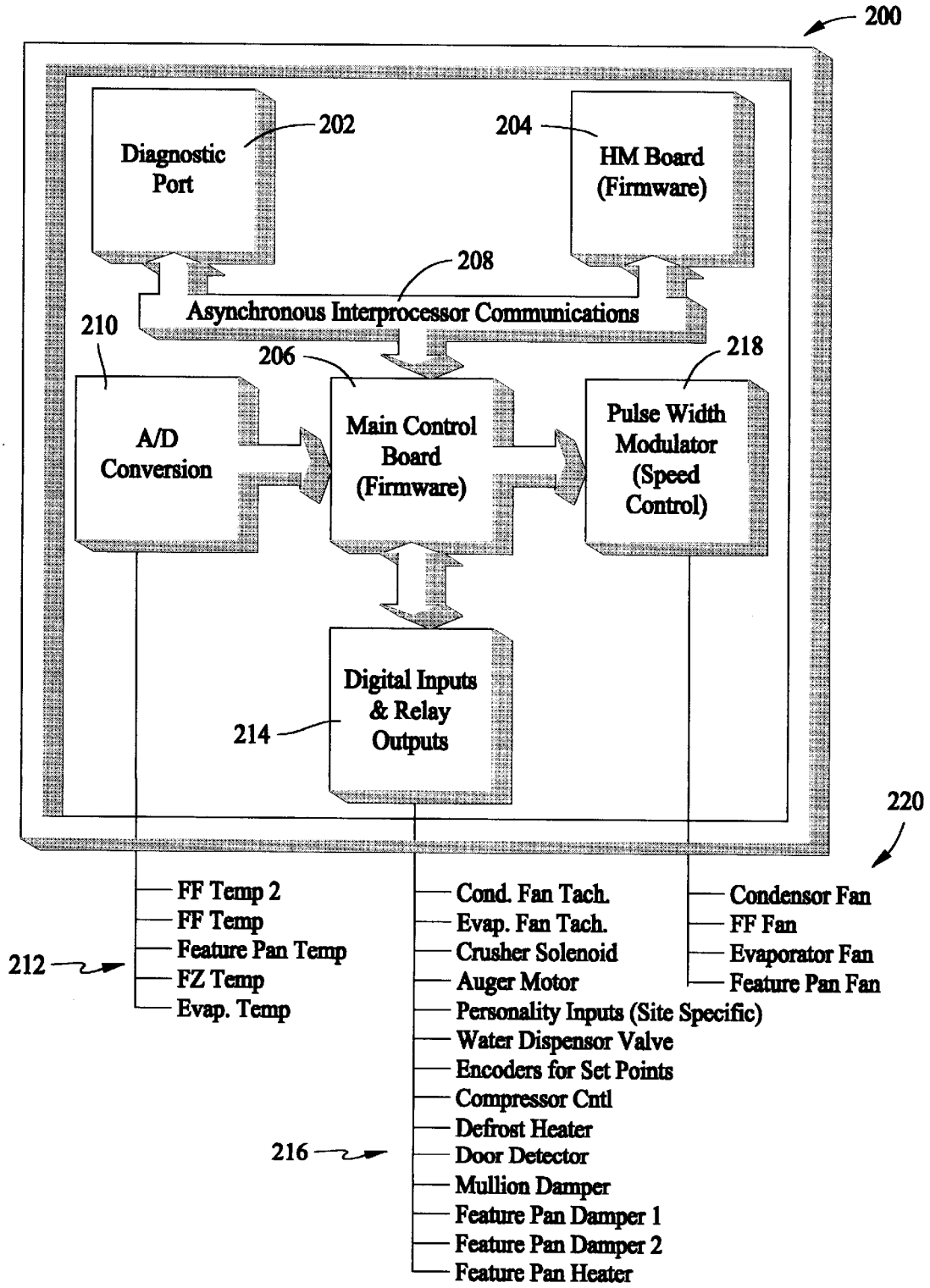
FIG. 2 is a block diagram of a refrigerator controller in accordance with one embodiment of the present invention.

FIG. 2 illustrates a controller 200 that can be used, for example, in refrigerators, freezers and combinations thereof, such as, for example side-by-side (S×S) refrigerator 100 (shown in FIG. 1). The present systems and methods are not limited to practice with any one specific controller, and controller 200 is illustrated and described herein as one example of a controller which can be configured to operate in accordance with the present invention.

Controller 200 includes a diagnostic port 202 and a human machine interface (HMI) board 204 coupled to a main control board 206 by an asynchronous interprocessor communications bus 208. An analog to digital converter ("A/D converter") 210 is coupled to main control board 206. Converter 210 converts analog signals from a plurality of sensors 212 including one or more fresh food compartment temperature sensors, feature pan temperature sensors, freezer temperature sensors, external temperature sensors, and evaporator temperature sensors into digital signals for processing by main control board 206.

Digital input and relay outputs 214 are supplied to and received from main control board 206. Such inputs and outputs 214 correspond to, but are not limited to variables 216 such as a condenser fan speed, an evaporator fan speed, a crusher solenoid, an auger motor, personality inputs, a water dispenser valve, encoders for set points, a compressor control, a defrost heater, a door detector, a mullion damper, feature pan air handler dampers, and a feature pan heater. Main control board 206 also is coupled to a pulse width modulator 218 for controlling variables 220 such as the operating speed of a condenser fan, a fresh food compartment fan, an evaporator fan, and a quick chill system feature pan fan.

Figure 3A:
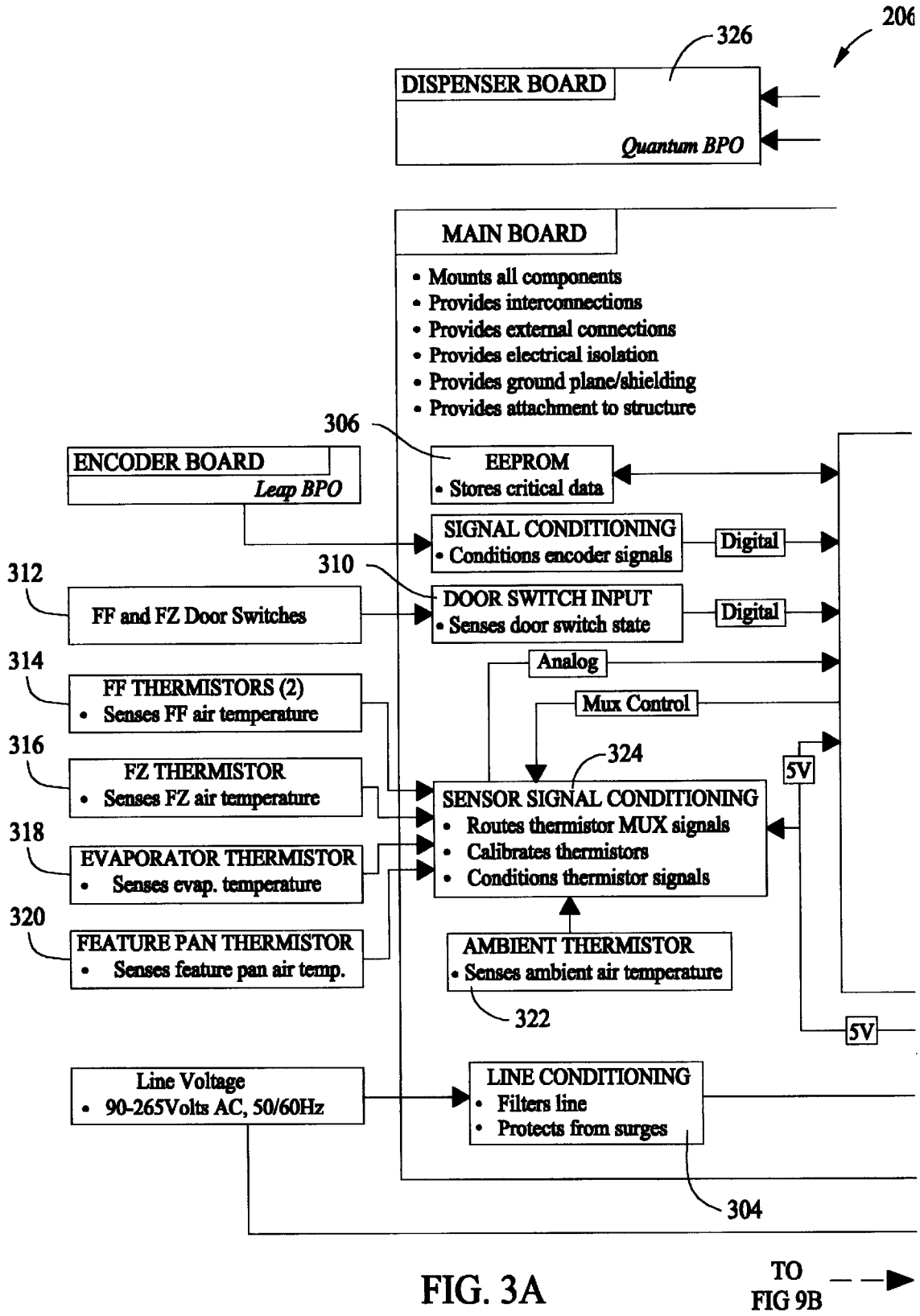
FIG. 3 is a block diagram of the main control board shown in FIG. 1.
Figure 3B:
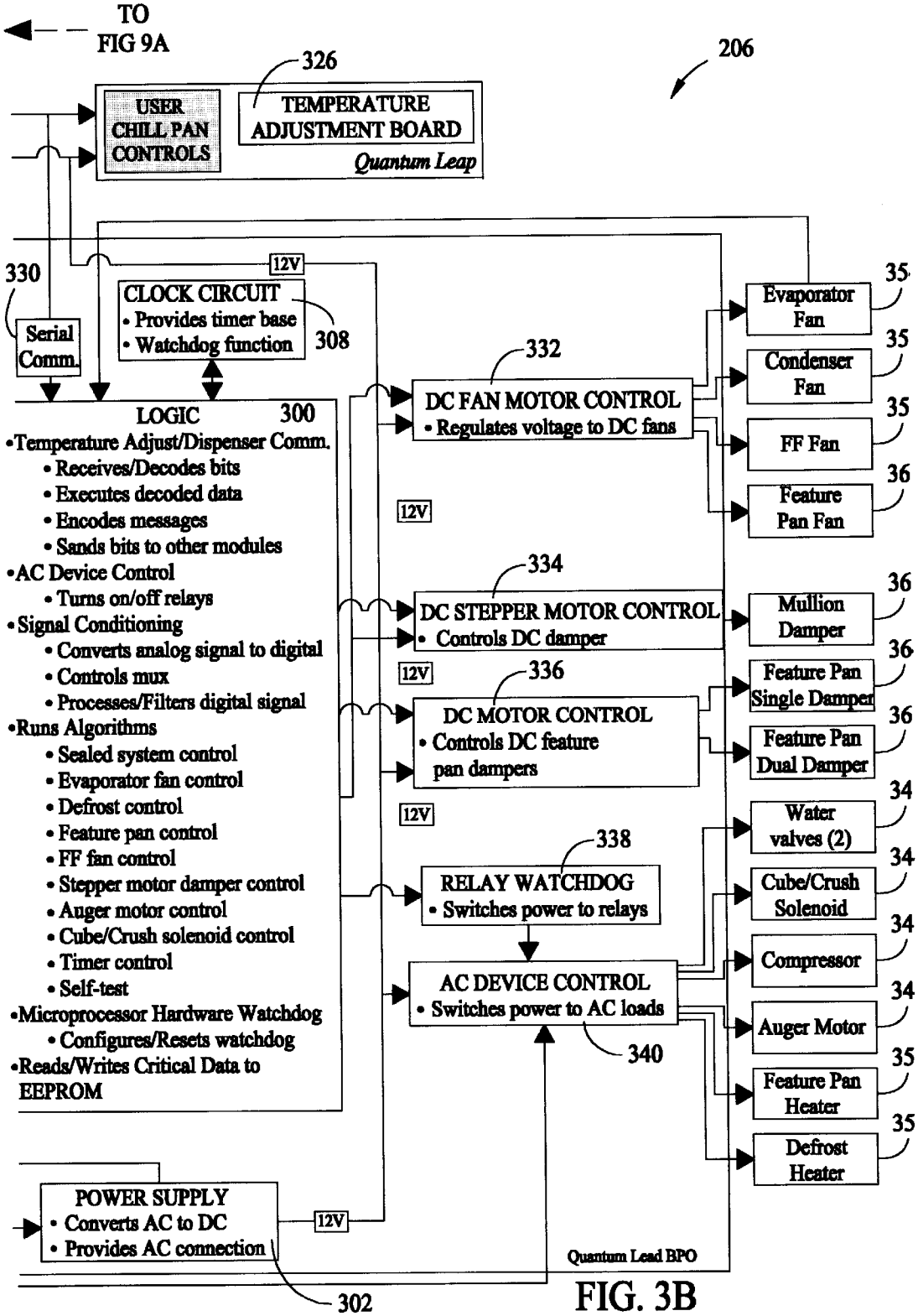
Figure 4:
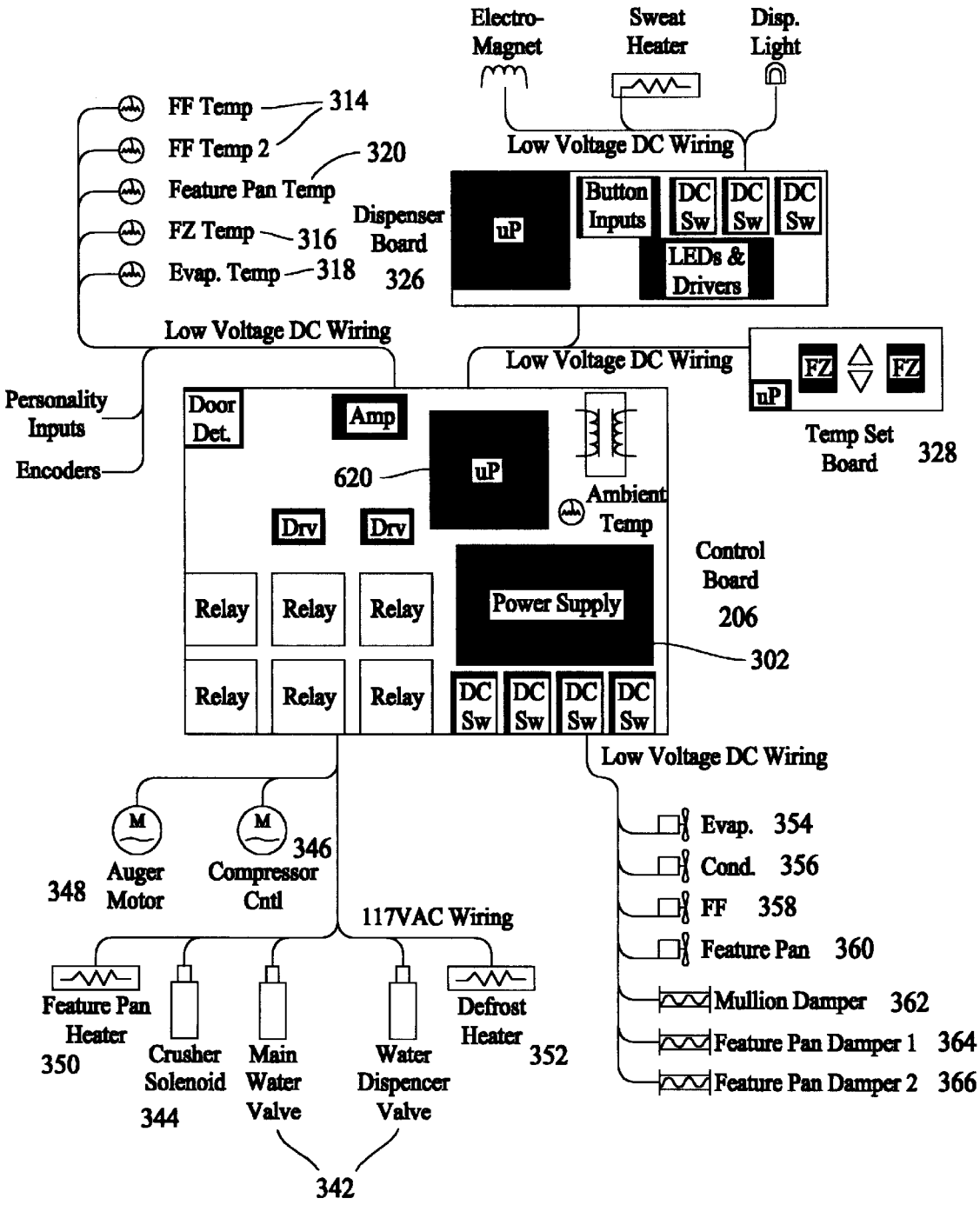
FIG. 4 is a block diagram of the main control board shown in FIG. 1.

FIGS. 3 and 4 are more detailed block diagrams of main control board 206. As shown in FIGS. 3 and 4, main control board 206 includes a processor 300. Processor 300 performs temperature adjustments/dispenser communication, AC device control, signal conditioning, microprocessor hardware watchdog, and EEPROM read/write functions. In addition, processor 300 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 300 is coupled to a power supply 302 which receives an AC power signal from a line conditioning unit 304. Line conditioning unit 304 filters a line voltage which is, for example, a 90–265 Volts AC, 50/60 Hz signal. Processor 300 also is coupled to an EEPROM 306 and a clock circuit 308.

A door switch input sensor 310 is coupled to fresh food and freezer door switches 312, and senses a door switch state. A signal is supplied from door switch input sensor 310 to processor 300, in digital form, indicative of the door switch state. Fresh food thermistors 314, a freezer thermistor 316, at least one evaporator thermistor 318, a feature pan thermistor 320, and an ambient thermistor 322 are coupled to processor 300 via a sensor signal conditioner 324. Conditioner 324 receives a multiplex control signal from processor 300 and provides analog signals to processor 300 representative of the respective sensed temperatures. Processor 300 also is coupled to a dispenser board 326 and a temperature adjustment board 328 via a serial communications link 330.

Processor 300 provides control outputs to a DC fan motor control 332, a DC stepper motor control 334, a DC motor control 336, and a relay watchdog 338. Watchdog 338 is coupled to an AC device controller 340 that provides power to AC loads, such as to water valve 342, cube/crush solenoid 344, a compressor 346, auger motor 348, a feature pan heater 350, and defrost heater 352. DC fan motor control 332 is coupled to evaporator fan 354, condenser fan 356, fresh food fan 358, and feature pan fan 360. DC stepper motor control 334 is coupled to mullion damper 362, and DC motor control 336 is coupled to feature pan dampers 364, 366.

Processor 300 includes logic to use the following inputs to make control decisions:

- Freezer Door State—Light Switch Detection Using Optoisolators,
- Fresh Food Door State—Light Switch Detection Using Optoisolators,
- Freezer Compartment Temperature—Thermistor,
- Evaporator Temperature—Thermistor,
- Upper Compartment Temperature in FF—Thermistor,
- Lower Compartment Temperature in FF—Thermistor,
- Zone (Feature Pan) Compartment Temperature—Thermistor, Compressor On Time, Time to Complete a Defrost, User Desired Set Points via Electronic Keyboard and Display or Encoders, User Dispenser Keys, Cup Switch on Dispenser, and Data Communications Inputs.

The electronic controls activate the following loads to control the refrigerator:

Multi-speed or variable speed (via PWM) fresh food fan,

Multi-speed (via PWM) evaporator fan,

Multi-speed (via PWM) condenser fan,

Single-speed zone (Special Pan) fan,

Compressor Relay,

Defrost Relay,

Auger motor Relay,

Water valve Relay,

Crusher solenoid Relay,

Drip pan heater Relay,

Zonal (Special Pan) heater Relay,

Mullion Damper Stepper Motor IC,

Two DC Zonal (Special Pan) Damper H-Bridges, and

Data Communications Outputs.

The electronic control system performs the following functions: compressor control, freezer temperature control, fresh food temperature control, multi speed control capable for the condenser fan, multi speed control capable for the evaporator fan (closed loop), multi speed control capable for the fresh food fan, defrost control, dispenser control, feature pan control (defrost, chill), and user interface functions. These functions are performed under the control of firmware implemented as small independent state machines.

Figure 5:
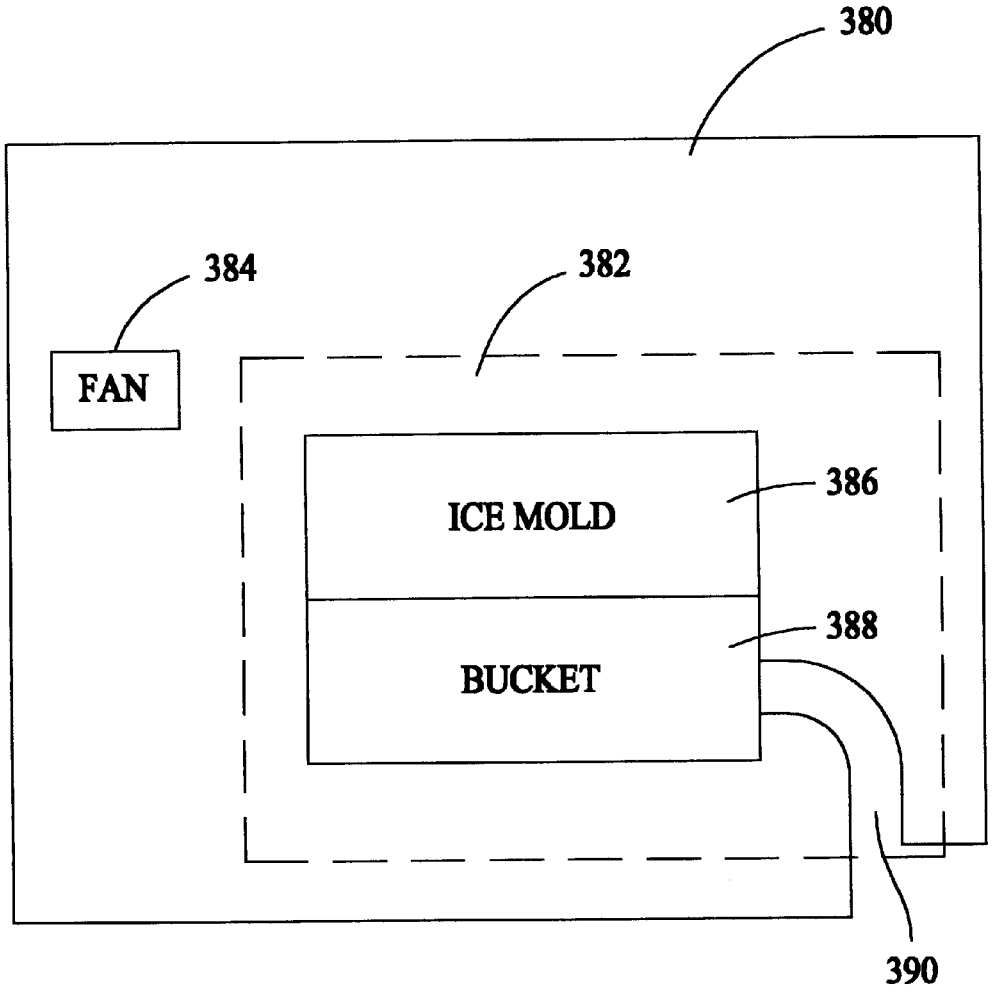
FIG. 5 is a schematic illustration of a refrigeration compartment including an icemaker.

In addition to the foregoing, processor 300 is configured to control evaporator fan 354 under certain conditions to facilitate the formation of ice at an increased, or boosted, rate of a refrigeration compartment 380, such as a freezer compartment, including an exemplary icemaker 382 as shown in FIG. 5. A fan 384 is located in compartment 380 to blow cold air over icemaker 382 to facilitate a rate of ice formation. Icemaker includes an ice mold 386 that receives water for forming ice cubes or blocks, and a bucket 388 for storage of ice cubes or blocks once they are formed and released from ice mold 386. In one embodiment, ice is dispensed from bucket 388 through a dispensing duct 390. In alternative embodiments, other known types of icemakers are employed. In a further embodiment, fan 384 is evaporator fan 354, while in still further embodiments, fan 384 is an auxiliary fan located in refrigeration compartment 380 to boost an ice formation rate.

Figure 6:
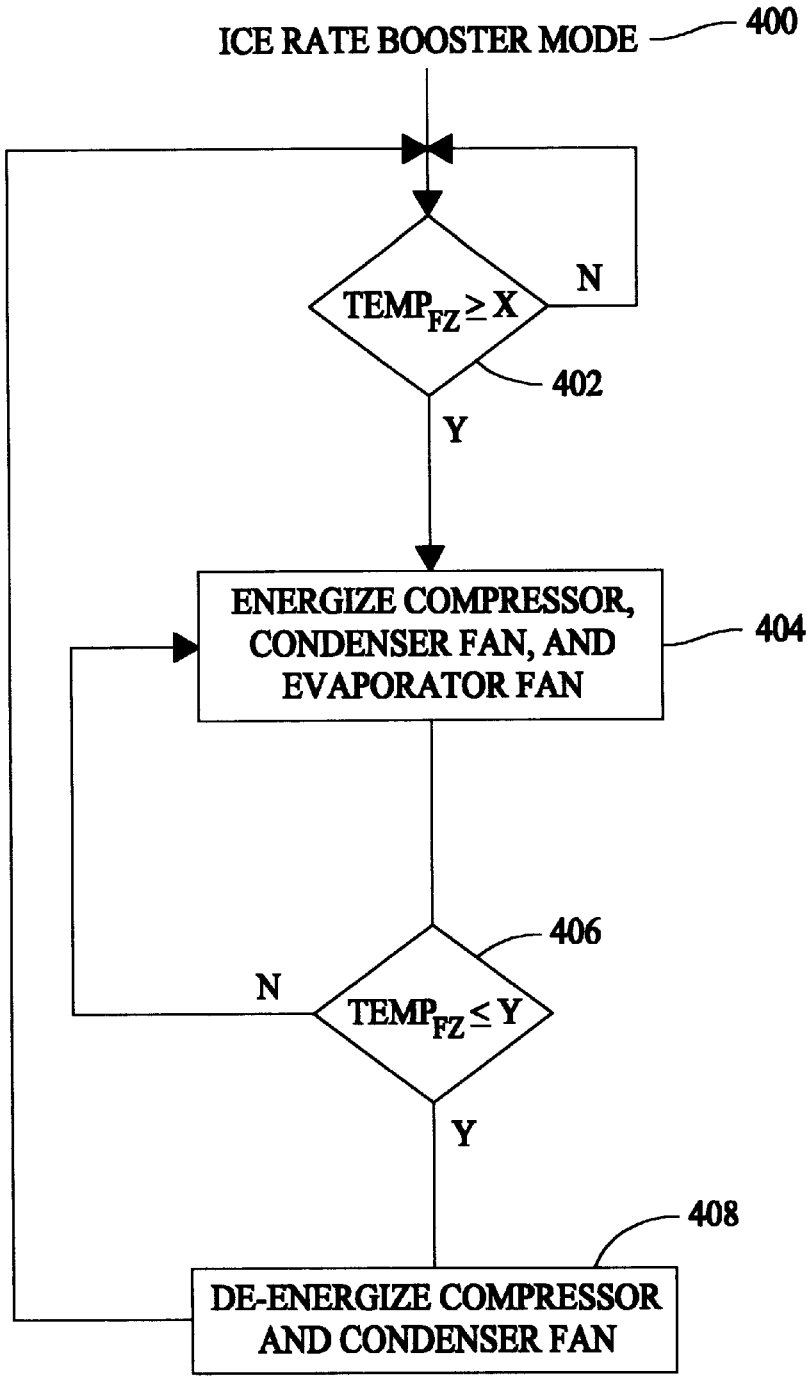
FIG. 6 is a flow chart illustrating control steps executed when in an ice booster mode.

More specifically, and referring to FIG. 6, in an ice rate booster mode 400, processor 300 checks the freezer temperature ($TEMP_{FZ}$) to determine whether the freezer temperature is greater than or equal to a pre-set temperature (X) 402. If no, the processor 300 continues performing the check 402. If yes, then processor 300 causes the compressor, condenser fan, and evaporator fan to be energized 404. Then, processor 300 checks whether the freezer temperature is less than or equal to a pre-set temperature (Y) 406. If no, then the compressor, condenser fan, and evaporator fan remain energized 404 and another check is 406 is performed. If yes, then only the compressor and the condenser fan are de-energized 408. That is, the evaporator fan remains energized to blow cold air over the ice maker.

In one embodiment, the evaporator fan is energized for an entire period between refrigeration cycles, i.e., when the compressor and condenser fan are de-energized, to facilitate ice making. In an alternative embodiment, the evaporator fan is energized for part of the period between refrigeration cycles, and de-energized for the remaining period between refrigeration cycles. After completion of a refrigeration cycle when the compressor and condenser fan are de-energized, operations then return to step 302 to check whether the freezer temperature has risen to or above pre-set temperature (X). Formation of ice in ice booster mode is therefore governed by the freezer temperature and air flow over the ice maker. By increasing air flow at a given temperature, or by lowering air temperature at a given air flow, or by combinations of adjusted temperature and air flow, rate of ice formation can be affected considerably.

As explained above, in the ice booster mode, the evaporator fan is maintained on so that the fan continues to blow cold air over the evaporator and over the ice mold of the ice maker. Such continuous flow of air over the mold facilitates formation of ice at a faster rate than if air was not being blown over the mold. In an alternative embodiment, an auxiliary fan is used to blow cold air over the ice mold of the ice maker, either separately or in conjunction with the evaporator fan.

The ice rate booster mode can be entered into in various ways. For example, the user interface could be configured to include an ice rate booster selection selectable by a user for consumer control of ice rate formation. Upon sensing selection of this option by the processor 300 (e.g., at the demand of the user and at a time selected by the user), processor 300 energizes the evaporator fan and/or adjusts freezer compartment temperature to facilitate the increased rate of ice formation.

In another embodiment, processor 300 can be programmed to automatically enter the ice booster mode and cause the freezer compartment to be operated at a colder temperature setting, including but not limited to a coldest possible selectable temperature when the ice rate booster mode is activated. By cooling the freezer compartment to a colder temperature, such conditions also facilitate increasing the rate of formation of ice in the icemaker as compared to when the freezer compartment is at higher temperature. Operating the freezer compartment at such colder temperature requires, of course, activating the refrigeration circuit to reduce the freezer temperature. In one embodiment, energization of the evaporator fan and fan rate is also automatically controlled when ice booster mode is activated.

In one embodiment, an ice level sensor (not shown) could be provided in connection with an ice container of the icemaker for automatic control of ice booster mode. Ice level sensors are well known. Once the level, or amount, of ice in the container falls below a pre-set level, then processor 300 could be programmed to automatically (i.e., without requiring any user input) enter into the ice rate booster mode.

In yet another embodiment, ice booster mode is implemented on a full time basis. That is, ice boosting mode is always activated.

As explained above, the method for controlling operation of the icemaker includes the steps of operating the freezer compartment in a first mode in which ice is made at a first rate, and in response to increased demand for ice, operating the freezer compartment in a second mode in which ice is made at a second rate, wherein the second rate is higher than the first rate. In the exemplary embodiment, the first mode is a normal operation mode wherein freezer compartment temperature is maintained at a selected temperature and the evaporator fan is energized and de-energized with the compressor and condenser fans to complete refrigeration cycles.

The second mode is an ice rate booster mode wherein freezer temperature and/or operation of the evaporator fan are adjusted to produce a satisfactory ice formation rate, as described above.

While the invention has been described in terms of various specific embodiments, those skilled in the art will recognize that the invention can be practiced with modification within the spirit and scope of the claims.

What is claimed is:

1. A refrigerator comprising:

a refrigerator compartment;

a freezer compartment, wherein a temperature of said freezer compartment is selectable by a user, said freezer temperature being selectable from a plurality of temperature settings;

an icemaker comprising an icemaker mold body located in said freezer compartment;

a fan positioned to blow air over said mold body; and a processor configured to control a rate of ice formation in said icemaker by adjusting at least one of a refrigerator compartment temperature and an operation of said fan, said processor is coupled to said user interface, and wherein upon selection of an ice rate booster mode at said user interface, said processor controls said freezer compartment temperature to be at a coldest temperature.

2. A refrigerator in accordance with claim 1 further comprising a user interface coupled to said processor, said processor also coupled to said evaporator and programmed to control energization of said fan upon selection of an ice rate booster mode at said user interface.

3. An icemaker assembly for a refrigerator, said icemaker assembly comprising:

an icemaker mold body; and a processor responsive to demand for increasing a rate at which ice is formed in said icemaker mold body operates the refrigerator from a first mode to a second mode wherein said second mode is colder than said first mode.

4. An icemaker assembly in accordance with claim 3 further comprising a fan coupled to said processor, said processor causing said fan to be energized in response to demand for increasing said ice forming rate.

5. An icemaker assembly in accordance with claim 3 further comprising a refrigeration circuit coupled to said processor, said processor causing said refrigeration circuit to be activated in response to demand for increasing said ice forming rate.

6. An icemaker assembly in accordance with claim 3 further comprising a fan coupled to said processor and a refrigeration circuit coupled to said processor, said processor causing at least one of said fan to be energized and said refrigeration circuit to be activated in response to demand for increasing said ice forming rate.

7. An icemaker assembly in accordance with claim 3 further comprising a user interface coupled to said processor, and wherein demand for increasing said ice forming rate is determined based on user selections at said interface.

8. An icemaker assembly in accordance with claim 3 further comprising an ice container for storing ice from said ice mold, and an ice level sensor coupled to said control for sensing an amount of ice in said ice container, and wherein demand for increasing said ice forming rate is determined based on a level of ice sensed by said ice level sensor in said ice container.

9. A method for controlling operation of an icemaker in a freezer compartment, said method comprising the steps of:

operating the refrigeration compartment in a first mode in which ice is made at a first rate; and in response to increased demand for ice, operating the refrigeration compartment in a second mode in which ice is made at a second rate, said second rate being higher than said first rate, wherein in the second mode, the freezer compartment is operated at a colder setting than in the first mode.

10. A method in accordance with claim 9 wherein the first mode is a normal operation mode.

11. A method in accordance with claim 9 wherein the second mode is an ice rate booster mode.

12. A method in accordance with claim 9 wherein a fan is positioned to blow air over the icemaker and wherein in the second mode, the fan is energized.

13. A method in accordance with claim 9 wherein increased demand for ice is determined based on user selections at a user interface.

14. A method in accordance with claim 9 wherein the icemaker includes an ice container and wherein increased demand for ice is determined based on a quantity of ice in the container.

15. A method in accordance with claim 9 wherein the icemaker is positioned in a freezer compartment of a refrigerator including a fresh food compartment and the freezer compartment, the refrigerator further including a refrigeration circuit for cooling the freezer and fresh food compartments, and wherein operation of the icemaker in the second mode is performed independently of cooling of the freezer and fresh food compartments.

* * * * *

UNITED STATES PATENT AND TRADEMARK OFFICE

CERTIFICATE OF CORRECTION

PATENT NO. : 6,655,158 B1
DATED : December 02, 2003
INVENTOR(S) : Wiseman et al.

It is certified that error appears in the above-identified patent and that said Letters Patent is hereby corrected as shown below:

Title page,
Item [75], Inventors, delete "Joshua Stepen Wiseman" and insert therefor -- Joshua Stephen Wiseman --.

Signed and Sealed this

Twenty-fifth Day of May, 2004

JON W. DUDAS
*Acting Director of the United States Patent and Trademark Office*